US012435882B2

(12) United States Patent
Heffel et al.

(10) Patent No.: US 12,435,882 B2
(45) Date of Patent: Oct. 7, 2025

(54) QUICK-FASTENING SYSTEM FOR A TELESCOPIC EXTENSION

(71) Applicant: Accuride International GmbH, Diez (DE)

(72) Inventors: Andreas Heffel, Dierdorf (DE); Karsten Diefenbach, Katzenelnbogen (DE)

(73) Assignee: Accuride International GmbH, Diez (DE)

( * ) Notice: Subject to any disclaimer, the term of this patent is extended or adjusted under 35 U.S.C. 154(b) by 364 days.

(21) Appl. No.: 18/200,701

(22) Filed: May 23, 2023

(65) Prior Publication Data

US 2023/0383960 A1 Nov. 30, 2023

(30) Foreign Application Priority Data

May 31, 2022 (DE) ..... 10 2022 113 764.3

(51) Int. Cl.
*F24C 15/16* (2006.01)

(52) U.S. Cl.
CPC ..... *F24C 15/168* (2013.01)

(58) Field of Classification Search
CPC ..... F24C 15/16; F24C 15/168; A47B 2210/17
USPC ..... 126/339
See application file for complete search history.

(56) References Cited

U.S. PATENT DOCUMENTS 8,573,720 B2 11/2013 Wittgrebe
8,851,591 B2 * 10/2014 Meier ..... A47B 88/43 126/339
9,078,517 B2 * 7/2015 Rehage ..... A47B 88/43
10,827,835 B2 * 11/2020 Kim ..... A47B 88/43
11,435,090 B2 * 9/2022 Rehage ..... F24C 15/16
2001/0044992 A1 * 11/2001 Jahrling ..... A47B 55/02 24/563
2005/0217501 A1 * 10/2005 Babucke ..... F24C 15/168 99/450
2009/0016812 A1 1/2009 Wittgrebe
2012/0145856 A1 6/2012 Reidt et al.
2016/0377223 A1 12/2016 Heffel et al.
2018/0084910 A1 3/2018 Homburg et al.
2019/0107291 A1 * 4/2019 Cetintas ..... F24C 15/168
2021/0293416 A1 9/2021 Homburg et al.
2022/0160128 A1 * 5/2022 Lee ..... F16B 2/245

FOREIGN PATENT DOCUMENTS

DE 202014100932 U1 3/2014
DE 102016118267 A1 3/2018
DE 102018116219 A1 1/2020
(Continued)

OTHER PUBLICATIONS

European Search Report for EP Patent Application No. 23172272.9, Issued on Sep. 20, 2023, 5 pages.

*Primary Examiner* — Avinash A Savani
(74) *Attorney, Agent, or Firm* — MEDLER FERRO WOODHOUSE & MILLS PLLC

(57) ABSTRACT

A quick-fastening system for releasably mounting a telescopic extension on a body, the quick-fastening system including a retaining bar which is fixed or can be fixed to the body directly or by means of a side grid, and a rear quick-fastening element and a front quick-fastening element for positive or positive and non-positive engagement with the retaining bar.

9 Claims, 5 Drawing Sheets

(56) References Cited

FOREIGN PATENT DOCUMENTS

| | | | |
|---|---|---|---|
| DE | 202019107001 | U1 | 3/2021 |
| EP | 1965680 | A1 | 9/2008 |
| EP | 2403380 | A1 | 1/2012 |
| EP | 2470835 | B1 | 10/2015 |
| WO | 2010/100198 | A1 | 9/2010 |
| WO | 2011/023561 | A1 | 3/2011 |

* cited by examiner

QUICK-FASTENING SYSTEM FOR A TELESCOPIC EXTENSION

CROSS REFERENCE TO RELATED APPLICATIONS

This application claims benefit of German Patent Application No. 10 2022 113 764.3 filed May 31, 2022.

OBJECT OF THE INVENTION

The present invention relates to a quick-fastening system suitable and adapted for releasably mounting a telescopic extension having a stationary rail element and at least one rail element movable relative to the stationary rail element, in a substantially horizontal orientation of the telescopic extension to a body, preferably to the body of furniture, including ovens, technical cabinets and computer racks.

BACKGROUND OF THE INVENTION

Telescopic extensions for furniture, for example, have a stationary rail element which is fixed to the furniture body, and at least one rail element which is mounted so as to be movable relative to the stationary rail element by means of friction bearings, ball bearings or roller bearings, for pulling out and pushing in an extension, such as a drawer, a shelf or a cooking tray, which is attached to or placed on the rail element. Particularly in the case of ovens, technical cabinets and computer racks, but also in other applications, it may be necessary or at least advantageous if the telescopic extensions can be easily mounted and dismounted without tools in order to replace them, clean them or simply arrange them at a height just required in the furniture body. Various quick-fastening systems for telescopic extensions are already known for this purpose.

In many commercially available baking ovens, in which the present invention is particularly preferred and can be used with advantage, two opposing side grids (mounting grids) are attached to the inner walls of the baking oven muffle, which are used for inserting or placing food carriers (baking trays, baking grids, drip trays, etc.) or also for attaching telescopic extensions.

Typically, such side grids in the orientation mounted on a muffle inner wall have at least two grid bars arranged vertically and substantially parallel to each other and usually a plurality of horizontal grid bars attached to and connecting the vertical grid bars. The horizontal grid bars of the side grid bars arranged on both sides on the inner walls of the muffle are used for placing and inserting the food carriers, which is why they are usually arranged at a distance in front of the plane formed by the vertical grid bars in the direction of the interior of the muffle. For connection to and attachment to the vertical grid bars, the horizontal grid bars each have an angled end section at their opposite ends.

To prevent the cooking tray from tipping when it is not completely pulled out of the muffle of the oven, for example, for processing or inspecting the food, pairs of horizontal grid bars are regularly provided on such side grids, which are arranged at a small distance above one another, which is sufficiently large to allow the cooking tray to be inserted between the two horizontal grid bars, but which is sufficiently small that the cooking tray can support itself with a rear edge against tipping on the upper horizontal grid bar. Usually, the horizontal grid bars are made of a wire with a circular cross-section because this permits cost-effective manufacture.

Modern and higher-quality baking ovens are equipped with telescopic extensions for holding and moving the cooking trays. In addition to the smooth movement of the cooking trays, another advantage of using telescopic extensions is that, with a sufficient number of movable rail elements, they also allow the cooking tray to be pulled completely out of the muffle without the cooking tray tipping off. Such telescopic extensions are conveniently attached to the existing side rails, whereby a stable but easily detachable and remountable attachment is expedient in order to be able to easily remove and reinsert the telescopic extensions for cleaning or for changing the position height within the muffle.

For this purpose, a wide variety of systems are known for the detachable fastening of telescopic extensions to side rails, in which at least one, often two or even more fastening elements are provided for connecting the telescopic extension to the bars of the side grid.

EP 2 403 380 describes a device for quick-fastening of telescopic extensions on a side rail, for example of a baking oven, with two so-called clamps which are attached to the underside of the stationary rail element in the vicinity of the two end sections and with which the telescopic extension is mounted on the upper side and not on the side of a horizontal grid bar of the side grid facing the muffle interior, so that the telescopic extension is placed as close as possible to the muffle side wall and projects only slightly into the muffle interior. The two clamps each have U-shaped sections which are pushed horizontally onto the horizontal grid bar in the direction of the muffle side wall to mount the telescopic extension and grip around it like a clamp. Furthermore, sections are provided on the clamps which are supported on the vertical bars of the side grid or likewise grip around these in a clamp-like manner. The clamps are intended to support the telescopic extension against shifting and tilting on the bars of the side grid in several spatial directions. In one variant of the clamps provided for mounting the telescopic extension in the front section facing the muffle opening, a spring-mounted detent is provided with which the clamp is latched to the bent end section or to the section of the horizontal grid bar extending rearward toward the rear wall of the muffle. In this case, the detent engages behind the horizontal grid bar on a side that is difficult to access by a user, which would make it difficult to disengage the detent for disassembly if the detent were not provided with a slope in the area adjacent to the horizontal grid bar, which is obviously intended to ensure easier removal of the clamp from the grid bar. However, this could also make it easier for the telescopic extension to accidentally detach from the side rail.

EP 1 965 680 describes a quick-fastening system for fastening a telescopic extension to a side grid of, for example, a baking oven with two quick fastening elements which are fastened in the vicinity of the two end sections on the side of the stationary rail element facing the muffle side wall and with which the telescopic extension is mounted on the side of a horizontal grid bar of the side grid facing the muffle interior. Each of the two quick-fastening members has two U-shaped sections oriented substantially at a 90° angle with respect to each other. A first U-shaped section of each of the two quick-fastening elements embraces the horizontal grid bar in its longitudinal extension region in a clamp-like manner, the opening of the U-shaped section facing in the direction of the muffle side wall. The second U-shaped section of each of the two quick-fastening elements, which is arranged perpendicular to the first U-shaped section, engages around the horizontal grid bar at one of the angled end sections in each case, with the openings of these second U-shaped sections facing one another. As with the previously described quick-fastening device, the telescopic extension with the two quick-fastening elements is slid horizontally onto the horizontal grid bar in the direction of the muffle side wall for mounting the telescopic extension. The second U-shaped sections, which grip around the grid bar at the angled end sections, prevent the telescopic extension from tilting. An impressed detent is provided on the first U-shaped sections for engagement with the horizontal grid bar in its longitudinal extension region to secure the fastener to the grid bar, so a force must be applied when sliding the quick fasteners on to engage the U-shaped sections with the grid bar. For mounting the rear quick fastener near the back wall of the muffle, this requires an operator to reach far into the oven muffle to precisely position the rear end of the telescopic extension with the rear quick fastener against the angled end section of the horizontal grid bar and apply the force required to engage it.

OBJECT OF THE INVENTION

The object of the present invention was to provide a quick-fastening system for detachably mounting a telescopic extension to a body which overcomes the disadvantages of known quick-fastening systems, permits easy mounting and dismounting of the telescopic extension to a side grid, and has a simple structure which is inexpensive to manufacture.

DESCRIPTION OF THE INVENTION

This object is solved by a quick fastening system of the type mentioned above, as defined in the appended patent claims, which is suitable and designed for releasably mounting a telescopic extension, which comprises a stationary rail element and at least one rail element mounted so as to be movable relative to the stationary rail element, in a substantially horizontal orientation of the telescopic extension on a body.

Definitions

According to the invention, the term body includes any surface to which a telescopic extension is expediently mounted in a substantially horizontal orientation in order to move an extension relative to the body, in particular furniture, such as cabinets, ovens, refrigerators and freezers, technical cabinets and computer racks, in which extensions, such as drawers, shelves, cooking trays, etc., are supported so as to be extendable relative to a wall surface or interior wall surface. Particularly advantageously, the present invention can be used in baking ovens in which cooking trays are extendably supported in the baking oven muffle by pairs of telescopic extensions fixed opposite each other on the muffle side walls.

Whenever reference is made herein and in connection with the present invention and its definition to "horizontal," "horizontal orientation," "vertical," "vertical orientation," "top," "bottom," "side," "front," and "back," the purpose is to describe the intended orientation and arrangement of the invention, individual elements of the invention, or other elements related to the invention in three-dimensional space and to define the orientation and arrangement of elements relative to one another and the features and embodiments thereof. It is understood that such orientation and arrangement indications, even if they designate the intended and/or preferred orientation and arrangement of the invention and its elements in three-dimensional space, are primarily intended to indicate reference points, reference directions and reference orientations for easier and more understandable description and definition of the invention, and do not limit the invention as a whole to a particular orientation in three-dimensional space. However, the horizontal orientation of the telescopic extension on a body is the intended orientation.

The term "perpendicular" is not used herein in the sense of "vertical" but to describe an orientation at a right angle (90°) with respect to an orientation, direction or plane mentioned in this context. The terms "top", "above", "from above", "bottom", "below", "from below", "height" and "width" describe positions or directions with respect to the vertical.

When reference is made herein and in the context of the present invention and its definition to "direction of extension" and "direction of insertion", this describes the two opposite directions of travel of a movably mounted rail element relative to the stationary rail element of a telescopic extension when the latter is mounted on a body by means of the quick fastening system according to the invention when oriented and used as intended by the invention. The term "direction of travel" describes a direction parallel to the "direction of extension" and "direction of insertion", regardless of whether the movably mounted rail element is extended or inserted.

The quick-fastening system according to the invention comprises at least one retaining bar which is fixed or fixable to the body directly or, as is particularly common in ovens, by means of a side grid. The quick-fastening system according to the invention further comprises a rear quick-fastening element and a front quick-fastening element for mounting the telescopic extension on the retaining bar, the rear quick-fastening element and the front quick-fastening element being fixed or fixable to the stationary rail element of the telescopic extension to be mounted on the body at a distance from one another in the direction of extension of the telescopic extension. In this regard, for purposes of defining the front and rear quick-fastening elements, the front quick-fastening element is arranged further in the extension direction of the telescopic extension than the rear quick-fastening element. In the case of a piece of furniture, the rear quick-fastening element is thus arranged closer to the rear wall of the piece of furniture, while the front quick-fastening element is arranged closer to the front side of the piece of furniture from which a stored pull-out is to be extended.

In connection with the description of the quick-fastening system according to the invention, in particular the retaining bar, the terms "rail side" or "at the rail side" describe an arrangement, position or orientation which, in relation to an element, e.g. the retaining bar, lies on the side of the element or points in the direction where the stationary rail element of the telescopic extension is located when the invention is oriented and used as intended. Accordingly, the terms "body side" or "at the body side" describe an arrangement, position or orientation which, with respect to an element, e.g. the retaining bar, lies on the side of the element or points in the direction where, in the intended orientation and use of the invention, the body surface is located to which the telescopic extension is mounted by means of the invention.

According to the invention, the rear and front quick-fastening elements are designed for positive or positive and force-fit engagement with the retaining bar for detachable mounting of the telescopic extension on the retaining bar.

The retaining bar of the quick-fastening system according to the invention has a straight extending horizontal section and, at opposite ends of the horizontal section, end sections which are each angled relative to the horizontal section. Suitably, the end sections are angled in the direction of the body or the side grid fixable to the body, preferably at an angle of about 90° relative to the horizontal section. The horizontal section expediently extends parallel to the longitudinal extent of the stationary rail member of the telescopic extension and is preferably shorter than the stationary rail member of the telescopic extension. The angled end sections are preferably of equal length. With their free ends, which are not angularly connected to the horizontal section, the end sections are each fixed or fixable to the body or to a side grid, for example to vertical rail bars of a side grid.

According to the invention, the horizontal section of the retaining bar has a cross-section perpendicular to its longitudinal extent which, when the horizontal section is oriented substantially horizontally, has a height (H) in its greatest extent which is at least twice as great as its width (B) perpendicular to the height (H). In a preferred embodiment of the invention, the cross-section of the retaining bar is a continuous cross-section, that is, there are no cross-sectional areas not connected to each other. Preferably, the retaining bar has straight side surfaces in cross-section on the rail side and/or on the body side, which may, however, have recesses or elevations in sections for engagement with the quick-fastening elements, which will be described below.

The cross-section of the horizontal section of the retaining bar according to the invention has significant advantages over the usually circular cross-section of horizontal grid bars, such as are known to be used in side grids for baking ovens for placing or inserting food trays or also for securing telescopic extensions. Whereas fastening to grid bars with a circular cross-section requires at least two additional supports to secure the telescopic extension against tilting about the longitudinal axis of the grid bar, the quick-fastening system according to the invention does not require any additional supports against tilting when the quick-fastening elements are positively engaged with the cross-section of the horizontal section of the retaining bar according to the invention. Furthermore, the cross-section according to the invention stabilizes the horizontal section of the retaining bar against bending when loaded from the top side.

According to the invention, the rear and front quick-fastening elements each have the following features, defined with reference to the retaining bar when the quick-fastening elements are engaged with the retaining bar for releasably mounting the telescopic extension:

The rear and the front quick-fastening element each have a fastening plate for fixing the quick fastening element to a surface, preferably a surface of the stationary rail element of the telescopic extension on the body side, i.e. facing away from the movably supported rail element. Expediently, the fastening plate of the quick-fastening element lies against this surface of the stationary rail element of the telescopic extension and is fastened thereto, preferably by welding, spot welding, riveting or screwing. For mounting the telescopic extension on the rail side of the retaining bar, i.e. on the side facing away from the body, the fastening plate is expediently aligned vertically and connected or connectable to a correspondingly vertical surface of the stationary rail element of the telescopic extension.

According to the invention, the rear and the front quick-fastening elements each further have a support section which extends from the fastening plate over the horizontal grid bar and is supported on the latter from above. Preferably, the support section has a section above the horizontal section of the retaining bar which extends perpendicularly to the fastening plate. Further preferably, the contour of the support section is adapted in cross-section at least in sections to the contour of the upper side of the horizontal section of the retaining bar.

Furthermore, according to the invention, the rear and front quick-fastening elements each have a first securing section which extends vertically downwards from the fastening plate on the rail side of the horizontal section of the retaining bar and rests on the rail side of the horizontal section of the retaining bar. Preferably, the contour of the first securing section is adapted in cross-section at least in sections to the contour of the rail side of the horizontal section of the retaining bar.

Furthermore, according to the invention, the rear and the front quick-fastening element each have a second securing section which adjoins the support section and extends vertically downwards on the body side of the horizontal section of the retaining bar and rests on the body side of the horizontal section of the retaining bar. Preferably, the contour of the second securing section is adapted in cross-section at least in sections to the contour of the body side of the horizontal section of the retaining bar.

In the direction of view of the longitudinal extension of the horizontal section of the retaining bar, the support section, the first securing section and the second securing section thus engage around the horizontal section in a substantially U-shaped manner from above and at least in sections in a form-fitting manner and thus secure the quick-fastening elements against tilting about the longitudinal axis of the horizontal section of the retaining bar.

In a preferred embodiment of the invention, the rear quick-fastening element, the front quick-fastening element or both quick-fastening elements are formed integrally from a sheet, preferably a sheet of steel. In this case, the required contours are expediently punched or cut from the flat sheet metal so that the individual sections of the quick-fastening element remain connected to one another, and the sheet metal is then bent and, if necessary, stamped in order to bring the individual sections of the quick-fastening element into the shape, position and orientation described herein in accordance with the invention. The quick-fastening elements can thus be inexpensively and efficiently manufactured from a single piece without the need for additional joining processes, such as welding or bolting.

In a quick-fastening element advantageously manufactured in one piece from a sheet of metal in this way, the support section and the second securing section adjoining it are arranged offset relative to the first securing section, preferably without overlapping, in the direction of the longitudinal extent of the horizontal section of the retaining bar, relative to the mounted state on the retaining bar.

Furthermore, according to the invention, the rear quick-fastening element has a lift-out securing section which adjoins the first securing section at an angle in the direction of the body side and extends horizontally, i.e. in the direction of the longitudinal extension of the horizontal section of the retaining bar, further in the insertion direction of the telescopic extension than the first securing section of the rear quick-fastening element.

According to the invention, the lift-out securing section is vertically disposed at a height of the quick-fastening element so as to extend below the angled end portion of the retaining bar lying in the insertion direction when the rear quick-fastening element is disposed at a position on the retaining bar at which the first securing portion abuts or butts against the angled end portion lying in the insertion direction.

In the mounted state, the lift-out securing section prevents the rear quick-fastening element from being disengaged from the retaining bar and the rear end of the telescopic extension from being lifted up or out, for example, when the movable rail element of the telescopic extension is extended and loaded, for example, by its own weight, the weight of an extension and/or when some other force is applied to the rail element from above. In the event of such a load, the lift-out securing section comes into contact with the underside of the rear, i.e. the angled end section of the retaining bar lying in the direction of insertion, and prevents the rear quick-fastening element from being lifted further vertically upwards.

In one embodiment of the invention, the rear quick-fastening element and the front quick-fastening element are formed identically, thereby reducing the manufacturing cost. In this case, the front quick-fastening element also has the lift-out portion provided for the rear quick-fastening element, but without the function as for the rear quick-fastening element. It is understood that for mounting of a pair of telescopic extensions on opposite sides of a body, for example on opposite side walls of a baking oven muffle, the opposite quick-fastening systems, including the quick-fastening elements, are expediently formed in mirror image.

In a preferred embodiment of the invention, the horizontal section of the retaining bar has one or more recesses or elevations on the rail side, on the body side or on the rail and body side, and embossments, bends or profiles complementary to the recesses or elevations are formed on the first and/or the second securing section of the quick-fastening element for positive engagement. For example, on the rail and/or body side, the horizontal section has a cross-section with a concave recess, and the securing section of the quick-fastening element that comes to rest on the respective side surface of the retaining section has an embossment, bend or other profiling which, when the quick-fastening element is mounted on the retaining bar, is guided over a wider cross-sectional area of the horizontal section by applying a force and comes to rest in the recess in the sense of a latch. This provides additional stabilization and securing of the quick-fastening element on the retaining bar against unintentional lifting. Such a shaping of the horizontal section of the retaining bar and the quick-fastening elements for an additional positive engagement or latching can be provided both in the front and in the rear section of the retaining bar, i.e. also for both the front and the rear quick-fastening element. However, such a design for an additional positive engagement is particularly advantageous in the front section of the retaining bar, since in the rear section the lift-out securing section on the rear quick-fastening element already prevents the rear quick-fastening element from being disengaged from the retaining bar and thus provides an additional safeguard.

In a further embodiment of the invention, the front quick-fastening element has a lift-securing hook which is formed in a rigid connection with the first securing section on the body side and can be swung out in the direction of the body side in a resiliently restorable manner with respect to the fastening plate, the lift-securing hook extending in sections under the horizontal section of the retaining bar in the direction of the rail side when the quick-fastening element is mounted on the retaining bar. The lift securing hook provides a further safeguard against unintentional lifting of the telescopic extension in the front section of the retaining bar. To release the lift-out protection by means of the lift-securing hook for disassembly of the telescopic extension from the retaining bar, the operator can press it in the direction of the body side against the resilient restoring force and thus release the quick-fastening element for lifting. Alternatively or additionally, a slope sloping down from the body side in the direction of the rail side can be provided on the lift-securing hook, which, when the front quick-fastening element connected to the telescopic extension is lifted with increased force, causes the lift-securing hook to swing out in the direction of the body side in that, due to the slope, a force component is generated in the direction of the body side when the lift-securing hook is brought up against the underside of the retaining section.

The invention also includes a quick-fastening system comprising a side grid provided and adapted to be fixed to a wall surface of the body, preferably to the inner wall of the muffle of an oven, wherein the side grid has a first vertical grid bar and a second vertical grid bar spaced therefrom and arranged substantially parallel thereto, and wherein the side grid has at least one retaining bar or a plurality of retaining bars of the type according to the invention described herein arranged one above the other in the vertical direction, and each of the end portions of a retaining bar which are angled with respect to the horizontal portion has its free end which is not angularly connected to the horizontal section, fixed to a respective one of the vertical grid bars in such a way that the horizontal section of the retaining bar extends substantially perpendicularly to the vertical grid bars.

In another embodiment of the invention, the quick-fastening system further comprises at least one or more telescopic extensions each having a stationary rail element and at least one rail element mounted for movement relative to the stationary rail element, wherein a rear quick-fastening element and a front quick-fastening element are fixed to the stationary rail element of each telescopic extension.

The front and rear quick-fastening elements according to the invention are designed and arranged on the telescopic extension so that they can be guided over and hooked into the retaining bar from above for assembly with the telescopic extension. It is expedient, when mounting the telescopic extension to the retaining bar, to first guide the rear quick-fastening element from above over the horizontal section of the retaining bar and hook it into the latter, and to push it backwards with the telescopic extension along the horizontal section, until the lift-out securing section of the rear quick-fastening element extends under the angled end section of the retaining bar lying in the insertion direction, preferably until the second securing section of the quick-fastening element lying on the body side of the horizontal section rests against the angled end section of the retaining bar lying in the insertion direction. The front of the telescopic extension is then lowered and the front quick-fastening element is guided from above over the horizontal section of the retaining bar and hooked into it.

Preferably, the front and rear quick-fastening elements are fixed to the stationary rail element of the telescopic extension at a distance such that the front quick-fastening element with its second securing section comes to lie close to the angled end section of the retaining bar lying in the extension direction when the second securing section of the rear quick-fastening element lies against the angled end section of the retaining bar lying in the insertion direction. In this way, the stationary rail element of the telescopic extension is also fixed on the retaining bar in the extension direction or fixed with little play in the travel direction.

FIGURES

Further advantages, features and possible applications of the present invention will become clear from the following description of an embodiment according to the invention and the accompanying figures. In the figures, identical elements are designated by identical reference signs.

Figure 1:
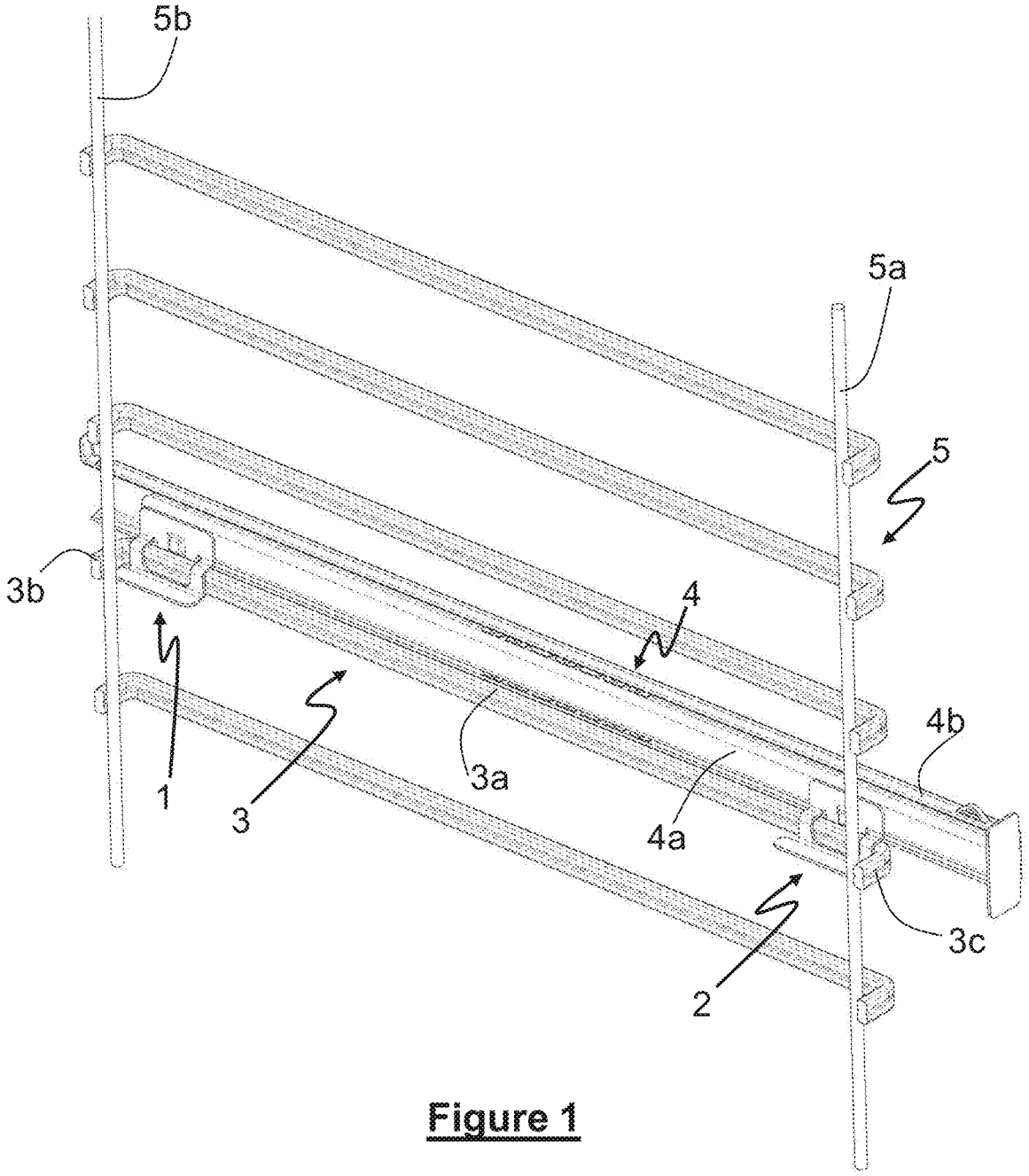
FIG. 1 shows a perspective view of an embodiment of the quick-fastening system according to the invention with a side grid and a telescopic extension mounted on a retaining bar according to the invention by means of quick-fastening elements according to the invention, viewed from obliquely above from the direction of the body side.

FIG. 1 shows a perspective view of an embodiment of the quick-fastening system according to the invention with a side grid 5 with a first (front) vertical grid bar 5*a* and a second (rear) vertical grid bar 5*b* arranged parallel to and at a distance from it, as well as a plurality of retaining bars 3 fixed one above the other on the vertical grid bars. Each retaining bar 3 has a straight extending horizontal section 3*a* and, at opposite ends of the horizontal section 3*a*, respective end sections 3*b* and 3*c* angled perpendicularly thereto, which are fixed via their free ends, which are not angled to the horizontal section 3*a*, to a respective one of the vertical grid bars 5*a*, 5*b* in such a way that the horizontal section 3*a* of the retaining bar 3 extends perpendicularly to the vertical grid bars 5*a*, 5*b* and horizontally when the device is used as intended.

As intended, a telescopic extension 4 with a stationary rail element 4*a* and a movable rail element 4*b*, which is movable with respect thereto via ball bearings, is mounted on one of the retaining bars 3 by means of the quick-fastening system according to the invention. The stationary rail element 4*a* has a conventional C-shaped profile with a substantially straight back side, which connects the ball running surfaces of the rail element and provides a surface for mounting a quick-fastening element 1 and 2 according to the invention (see also FIGS. 4 and 5—shown there without ball bearings). The rear quick-fastening element 1 is fixed in the rear region of the rail element 4*a* or of the retaining bar 3, respectively, so that in the assembled state shown here it rests with the body-side first securing section 1*c* against the rear angled end section 3*b* of the retaining bar 3 and the lift-out securing section 1*e* partially extends under the angled end section 3*b*. The front quick-fastening element 2 is fixed in the front region of the rail element 4*a* or of the retaining bar 3, respectively, so that in the assembled state shown here it reaches with the body-side first securing section 2*c* in the pull-out direction of the telescopic extension 4 almost as far as the front angled end section 3*c* of the retaining bar 3.

The quick-fastening elements 1 and 2 of this embodiment are each made in one piece from approximately 1 mm thick sheet steel by punching out the structures, stamping and bending. As can also be seen in the further detailed views of FIGS. 2 to 4 and 7, for manufacturing reasons, the support section 1*b* or 2*b* and the second securing section 1*d* or 2*d* adjoining it are offset in the direction of the longitudinal extent of the horizontal section 3*a* of the retaining bar 3 in relation to the first securing section 1*c* or 2*c* without overlapping.

Figure 2:
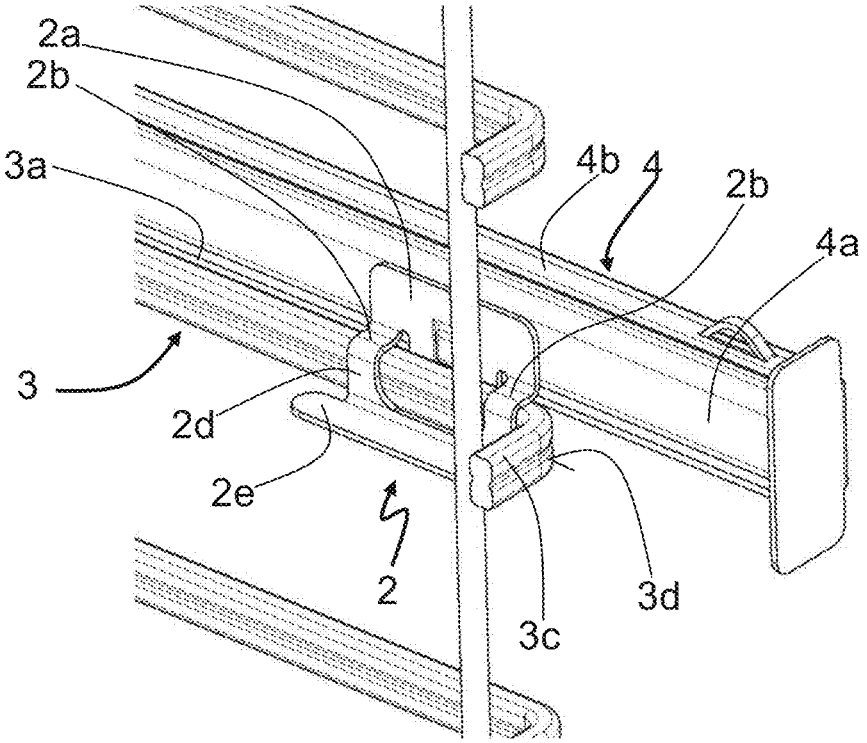
FIG. 2 shows a broken-away detail view of the embodiment according to FIG. 1 in the region of the front quick-fastening element, viewed from obliquely above from the direction of the body side.

FIG. 2 shows a broken-away detailed view of the embodiment according to FIG. 1 in the region of the front quick-fastening element 2. The front quick-fastening element 2 is fixed to the stationary rail element 4*a* of the telescopic extension 4 via the fastening plate 2*a*. The retaining bar 3 of this embodiment has a substantially rectangular cross-section with rounded corners throughout and, at about half the height on both the body side and the rail side, a recess 3*d* extending over the entire retaining bar. The support section 2*b* extends from the mounting plate 2*a* over the horizontal section 3*a* of the retaining bar 3 and is supported on the latter from above. The second securing section 2*d* adjoins the support section 2*b* at an angle, extends vertically downward on the body side of the horizontal section 3*a* of the retaining bar 3, and rests on the body side of the horizontal section 3*a* of the retaining bar 3. In this preferred embodiment, the support section 2*b* and the second securing section 2*d* extend from the mounting plate 2*a* in two parts with respect to the longitudinal direction of the retaining bar, and when viewed from the front, the first securing section 2*c* extends vertically downward therebetween from the mounting plate 2*a* on the rail side of the horizontal section 3*a* of the retaining bar 3 and abuts the horizontal section 3*a* of the retaining bar 3 on the rail side.

Adjacent to the first securing section 2*d*, angled in the direction of the body side, is an lift-out securing section 2*e*, which extends with a section horizontally further in the insertion direction of the telescopic extension 4 than the first securing section 2*d*. However, in the case of the front quick-fastening element 2, the lift-out securing section 2*e* has no function, whereas in the case of the identically constructed rear quick-fastening element 1 it provides anti-lift protection in the rear region of the telescopic extension.

Figure 3:
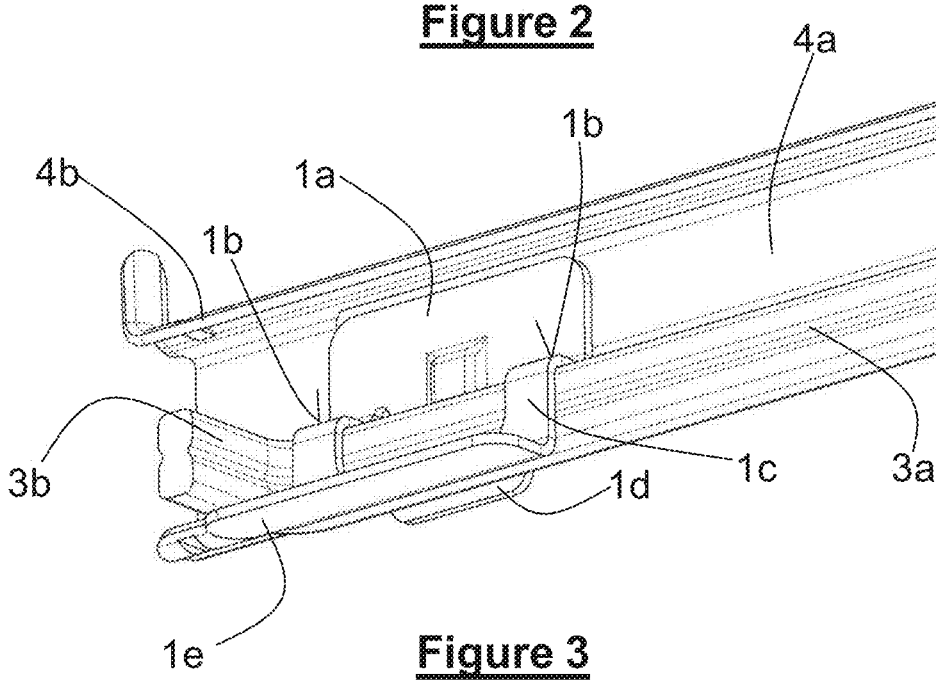
FIG. 3 shows a broken-away detail view of the embodiment according to FIG. 1 in the area of the rear quick-fastening element, viewed from obliquely below from the direction of the body side.

FIG. 3 shows a broken-away detailed view of the embodiment according to FIG. 1 in the region of the rear quick-fastening element 1, which is formed in the same way as the front quick-fastening element 2. FIG. 3 shows how the lift-out securing section 1*e* of the rear quick-fastening element 1 comes to lie under the rear angled end section 3*b* of the retaining bar 3 in the assembled state and effects an anti-lift protection in the rear area of the telescopic extension.

Figure 4:
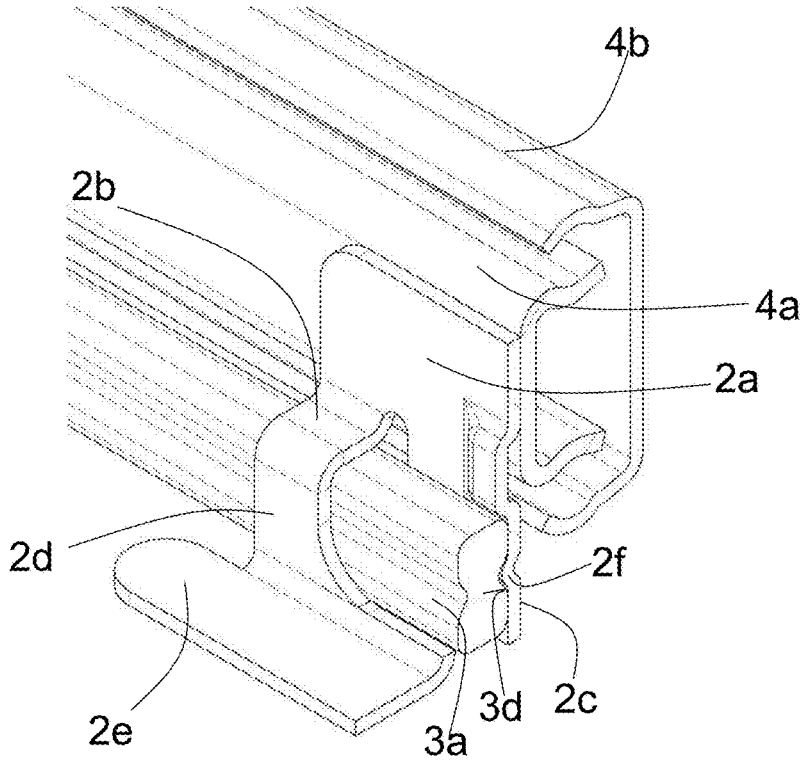
FIG. 4 shows a view of a cross-section through the front quick-fastening element and the horizontal section, provided with a recess in this section, of the retaining bar of the embodiment according to FIG. 1.

FIG. 4 shows a view of a cross-section through the front quick-fastening element 2 and in the mounted state on the horizontal section 3*a* of the retaining bar 3. The first securing section 2*c*, which extends vertically downwards on the rail side of the horizontal section 3*a* of the retaining bar 3, has an embossing or bend 2*f*, which is complementary to the recess 3*d* or at least matches it, for positive engagement of the first securing section 2*c* with the horizontal section 3*a* in the mounted state.

Figure 5:
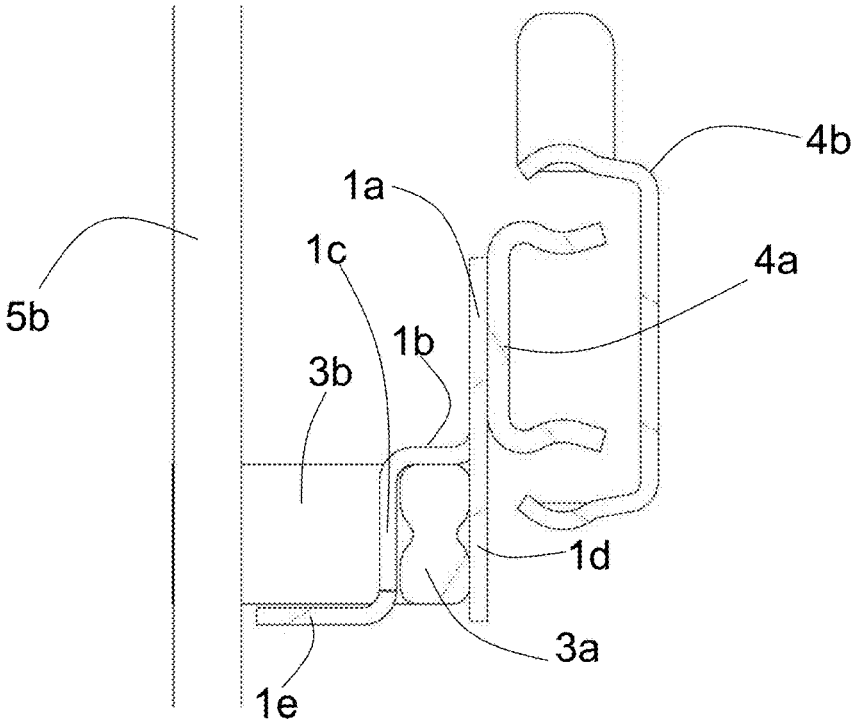
FIG. 5 shows a view of a cross-section through the rear quick-fastening element and the horizontal section, not provided with a recess in this section, of the retaining bar of the embodiment according to FIG. 1.

FIG. 5 shows a view of a cross-section through the rear quick-fastening element 1, looking from front to rear.

Figure 6:
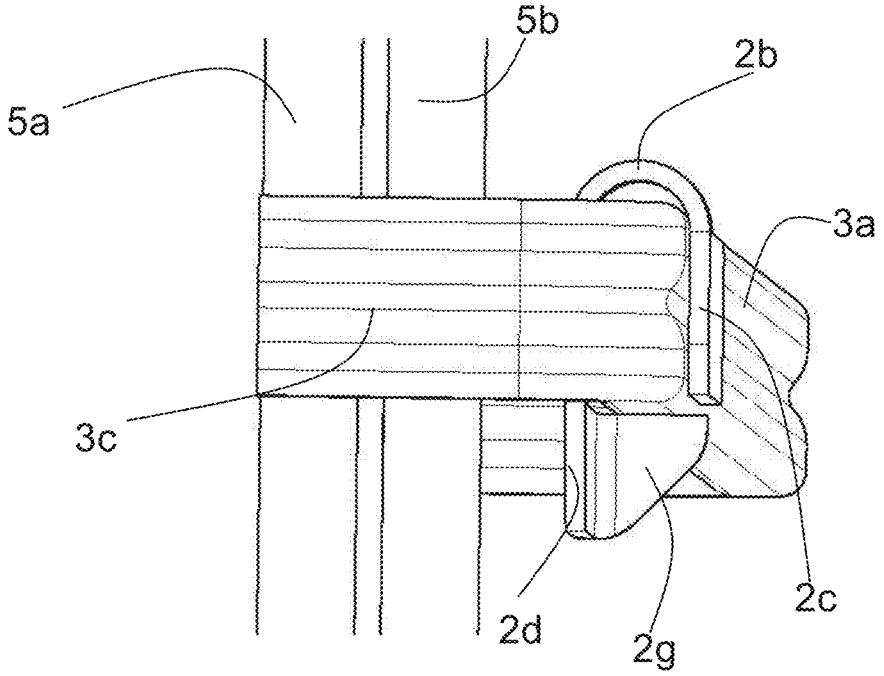
FIG. 6 shows a view of a cross-section through an alternative embodiment of a front quick-fastening element with a lift-securing hook and the horizontal section of the retaining bar not provided with a recess in this section.

FIG. 6 shows a view of a cross-section through an alternative embodiment of a front quick-fastening element 2 with an lift-out securing hook 2*g*, which is formed in a rigid connection with the body-side first securing section 2*c* of the front quick-fastening element 2 and can be resiliently swung out in the direction of the body side relative to the fastening plate 2*a* (not shown here). In the mounted state, the lift-out securing hook 2*g* extends in sections under the horizontal section 3*a* of the retaining bar 3 in the direction of the rail side.

Figure 7:
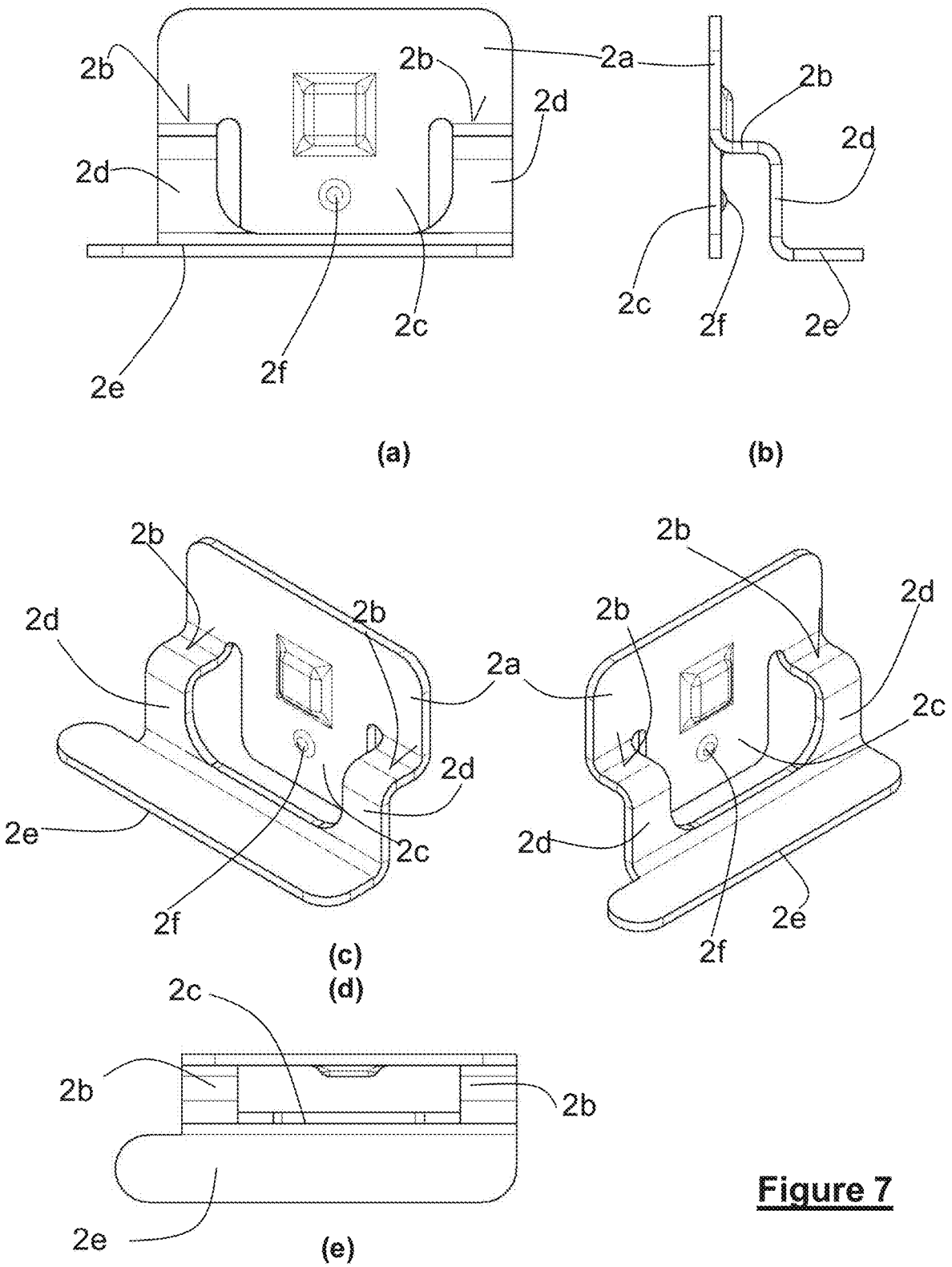
FIG. 7 shows views of the front quick-fastening element (identical in construction to the rear quick-fastening element) of the embodiment according to FIGS. 1 to 5 from different viewing directions: (a) from the front; (b) from the left, (c) from obliquely above on the right; (d) from obliquely above on the left; (e) from below.

FIG. 7 shows views of the front quick-fastening element of the embodiment according to FIGS. 1 to 5 alone from different viewing directions. In this case, it is identical in construction to the rear quick-fastening element, although embossing 2*f* can be omitted from the rear quick-fastening element.

For the purposes of the original disclosure, it is pointed out that all features as they become apparent to a person skilled in the art from the present description, the drawings and the claims, even if they have been specifically described only in connection with certain further features, can be combined both individually and in any desired combinations with other of the features or groups of features disclosed herein, unless this has been expressly excluded or technical circumstances make such combinations impossible or pointless. A comprehensive, explicit presentation of all conceivable combinations of features is omitted here only for the sake of brevity and readability of the description.

While the invention has been illustrated and described in detail in the drawings and the foregoing description, this description of embodiments is by way of example only and is not intended to limit the scope of protection as defined by the claims. The invention is not limited to the embodiments shown.

Variations of the disclosed embodiments will be obvious to those skilled in the art from the drawings, description, and appended claims. In the claims, the word "comprising" does not exclude other elements or steps, and the indefinite article "a" does not exclude a plurality. The mere fact that certain features are claimed in different claims does not preclude their combination. Reference signs in the claims are not intended to limit the scope of protection.

REFERENCE LIST

1 rear quick-fastening element
1*a* fixing plate
1*b* support section
1*c* first (rail side) securing section
1*d* second (body side) securing section
1*e* lift-out securing section
2 front quick fastening element
2*a* fixing plate
2*b* support section
2*c* first (rail side) securing section
2*d* second (body side) securing section
2*e* lift-out securing section
2*f* embossing, bending or profiling
2*g* lift-out securing hook
3 retaining bar
3*a* horizontal section of the retaining bar
3*b* (rear) angled end section of the retaining bar
3*c* (front) angled end section of the retaining bar
3*d* recess, embossing
4 telescopic extension
4*a* stationary rail element
4*b* movable rail element
5 side grid
5*a* first vertical grid bar
5*b* second vertical grid bar

The invention claimed is:

1. A quick-fastening system suitable and adapted for releasably mounting a telescopic extension comprising a stationary rail member and at least one rail member movably supported relative to the stationary rail member, in a substantially horizontal orientation of the telescopic extension on a body, wherein the quick-fastening system comprises a retaining bar (3) fixed or fixable to the body directly or by means of a side grid, and a rear quick-fastening element and a front quick-fastening element, wherein the rear and the front quick-fastening elements are fixed or can be fixed at a distance from one another in the pull-out direction of the telescopic extension and with the front quick-fastening element further in the pull-out direction than the rear quick-fastening element to the stationary rail element of the telescopic extension to be mounted on the body, and wherein the rear and the front quick-fastening elements are designed for positive or positive and force-fit engagement with the retaining bar for releasably mounting the telescopic extension on the retaining bar, wherein the retaining bar has a straight extending horizontal section and at opposite ends of the horizontal section respective end sections at opposite ends of the horizontal section, and wherein the horizontal section of the retaining bar has a cross-section perpendicular to its longitudinal extent which, when the horizontal section is oriented substantially horizontally, in its greatest extent has a height which is at least twice as great as its width perpendicular to the height, the rear and front quick-fastening elements each having the following features, defined with reference to the retaining bar when the quick-fastening elements are engaged with the retaining bar for releasably mounting the telescopic extension:

a fixing plate for fixing the quick-fastening element to a surface of the stationary rail element of the telescopic extension, a support section extending from the fixing plate over the horizontal section of the retaining bar and supported thereon from above, a first securing section which extends vertically downwardly from the fixing plate on the rail side of the horizontal portion of the retaining bar and abuts the horizontal portion of the retaining bar on the rail side, a second securing section which adjoins the support section and extends vertically downwards on the body side of the horizontal section of the retaining bar and bears on the body side against the horizontal section of the retaining bar, wherein the rear quick-fastening element has a lift-out securing portion which is angled in the direction of the body side to join the first securing section and extends horizontally further in the insertion direction of the telescopic extension than the first securing section of the rear quick-fastening element, wherein the lift-out securing portion is vertically disposed at a height of the quick-fastening element so as to extend below the angled end portion of the retaining bar lying in the insertion direction when the rear quick-fastening element is positioned in a position on the retaining bar at which the first securing section abuts the angled end portion lying in the insertion direction.

2. The quick-fastening system according to claim 1, wherein the horizontal section of the retaining bar has one or more recesses or elevations on the rail side, on the body side or on the rail and body side, and the first securing section, the second securing section or both securing sections have embossments, bends or profiles complementary to the recesses or elevations for positive engagement.

3. The quick-fastening system according to claim 1, wherein the horizontal section of the retaining bar has a continuous cross-section perpendicular to its longitudinal extension.

4. The quick-fastening system according to claim 1, wherein the rear and front quick-fastening elements are of identical design.

5. The quick-fastening system according to claim 1, wherein the rear quick-fastening element, the front quick-fastening element or both quick-fastening elements are formed in one piece from a metal sheet.

6. The quick-fastening system according to claim 1, wherein the front quick-fastening element has a lift-out securing hook which is formed in a rigid connection with the first securing section on the body side and can be swung out in the direction of the body side in a resiliently restorable manner with respect to the fixing plate, the lift-out securing hook extending in sections under the horizontal section of the retaining bar in the direction of the rail side.

7. The quick-fastening system according to claim 1, wherein the fixing plate of the quick-fastening element abuts against a surface of the stationary rail element of the telescopic extension facing away from the movable rail element and is fastened thereto, preferably by welding, spot welding, riveting or screwing.

8. The quick-fastening system according to claim 1, it wherein the system comprises a side grid provided and adapted to be fixed to a wall surface of the body, wherein said side grid comprises a first vertical grid bar and a second vertical grid bar spaced apart therefrom and arranged substantially parallel thereto, and wherein said side grid comprises at least one retaining bar or a plurality of retaining bars arranged one above the other in the vertical direction, and each of the end portions of a retaining bar angled relative to the horizontal section is fixed via its free end, which is not connected at an angle to the horizontal section, to a respective one of the vertical grid bars in such a way that the horizontal section of the retaining bar extends substantially perpendicularly to the vertical grid bars.

9. The quick-fastening system according to claim 8, it wherein the system comprises at least one or more telescopic extensions, each of which has a stationary rail element and at least one rail element mounted so as to be movable relative to the stationary rail element, a rear and a front quick-fastening element being fixed to the stationary rail element of each telescopic extension.

* * * * *